US005342169A

United States Patent [19]

Müller

[11] Patent Number: 5,342,169

[45] Date of Patent: Aug. 30, 1994

[54] AXIAL FLOW TURBINE

[75] Inventor: Ferdinand Müller, Albbruck-Buch, Fed. Rep. of Germany

[73] Assignee: Asea Brown Boveri Ltd., Baden, Switzerland

[21] Appl. No.: 42,528

[22] Filed: Apr. 5, 1993

[30] Foreign Application Priority Data

Apr. 25, 1992 [DE] Fed. Rep. of Germany ..... 4213709

[51] Int. Cl.[5] ..... F01D 25/00

[52] U.S. Cl. ..... 415/160; 415/912

[58] Field of Search ..... 415/151, 159, 160, 912

[56] References Cited

U.S. PATENT DOCUMENTS

| | | | |
|---|---|---|---|
| 3,935,625 | 2/1976 | Saterdal | 415/912 |
| 4,089,617 | 5/1978 | Koeller . | |
| 4,900,223 | 2/1990 | Groenendaal, Jr. | 415/190 |

FOREIGN PATENT DOCUMENTS

| | | | |
|---|---|---|---|
| 0253234 | 10/1989 | European Pat. Off. . | |
| 1406472 | 6/1965 | France . | |
| 1474285 | 4/1989 | U.S.S.R. . | |
| 368160 | 3/1932 | United Kingdom | 415/912 |
| 700859 | 12/1953 | United Kingdom | 415/912 |

*Primary Examiner*—Edward K. Look
*Assistant Examiner*—James A. Larson
*Attorney, Agent, or Firm*—Burns, Doane, Swecker & Mathis

[57] ABSTRACT

In an axial flow turbine with a row of individually adjustable guide vanes (8) and a row of rotor blades (5), the guide vanes can be rotated by an adjusting shaft (9) supported in a casing (4) and passing through a vane carrier (3). The tips of the rotor blades seal against a cover (7). In order to match the duct contour to different heights of blading (5, 8), only the vane carrier (3) and the cover (7) are designed to be exchangeable, with otherwise unaltered machine geometry.

1 Claim, 1 Drawing Sheet

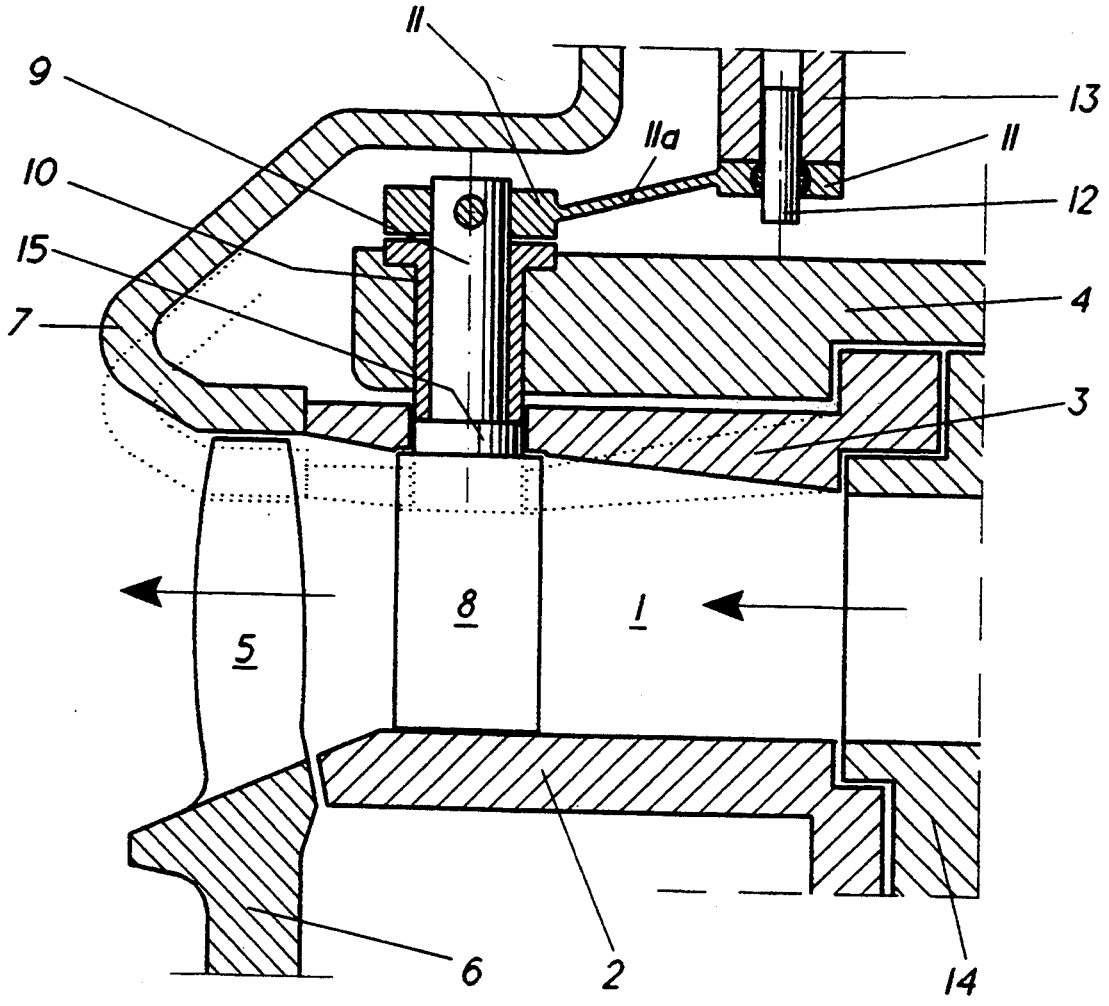
11
9
10
15
7
11a
13
11
12
4
3
8
1
5
6
2
14

AXIAL FLOW TURBINE

BACKGROUND OF THE INVENTION

2. Field of the Invention

The invention relates to an axial flow turbine with at least one row of individually adjustable guide vanes and at least one row of rotor blades, in which the guide vanes can be adjusted by means of an adjusting shaft, supported in a casing and passing through a vane carrier, and in which the tips of the rotor blades seal against a cover.

2. Discussion of Background

Such turbines are sufficiently known in the case of exhaust gas turbochargers, for example. As a control intervention to improve the acceleration and the torque behavior, guide vane adjustment on the turbine is, in addition to guide vane adjustment on the compressor, also a possible measure. One example of this is provided by EP 253 234 A1. The adjustable turbine guide vanes are intended to generate a larger heat drop for a given throughput. The turbine power, the turbine rotational speed and, finally, the boost pressure are increased by this means. So that the adjustable vanes do not jam during "hot" operation, they must, as a rule, be installed with an appropriate clearance. Particularly in the closed condition, the gap flow at the tip and the root of the vanes can greatly disturb the main flow in the duct. Since, furthermore, large fluid forces act on the adjustable vanes in the axial and peripheral directions, the vanes often have to be encastré at both the tip and the root in order to relieve the load on the adjusting shaft.

Furthermore, it is known art to match a turbomachine of a given size to a mass flow by varying the height of the blading.

SUMMARY OF THE INVENTION

Accordingly, one object of the invention is, in axial flow turbines of the type mentioned at the beginning, to make the variable turbine geometry possible both by rotating the guide vanes and by matching the height of the blading.

This is achieved according to the invention by, in addition to the blading, only the vane carrier and the cover being designed to be exchangeable, with otherwise unaltered machine geometry, in order to match the duct contour to different heights of blading.

This solution has, inter alia, the advantage that the adjusting mechanism is not impaired when the elements are exchanged.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single figure shows a partial longitudinal section through the turbine of an embodiment example of the invention using a single-stage exhaust gas turbocharger turbine with axial/radial outlet.

DESCRIPTION OF THE PREFERRED EMBODIMENTS

Referring now to the drawing—wherein the flow direction of the working medium is indicated by arrows, and where only the elements essential to understanding the invention are shown (parts of the installation not shown, for example, are the compressor part, the casing, the rotor including bearings, etc.)—the walls bounding the flow duct 1 in the gas turbine shown diagrammatically in FIG. 1 are, on the one hand, the inner hub 2 and, on the other, the outer vane carrier 3. The latter is suspended, in a manner not shown in any more detail, in the casing 4 and in an inlet flow casing 14 arranged upstream. In the region of the rotor blades 5, the duct 1 is bounded at the inside by the rotor disk 6 and at the outside by the cover 7.

The adjustable guide vanes 8 are preferably integrally embodied with their respective adjusting shaft 9, a collar 15 connecting the shaft 9 to the vane aerofoil. The shaft 9 is supported in a bush 10 which passes through the casing 4 and partially through the vane carrier 3. At its end protruding from the bush 10, the shaft is connected to a pivoting lever 11. This lever is connected by a pin 12 to an adjusting ring 13.

The actual adjustment of the guide vanes 8 in the cascade takes place via the lever linkage 9, 11, 12, 13 by means of actuation means (not shown) such as are known, for example, from compressor manufacture. The adjustment preferably takes place automatically as a function of operating parameters such as boost pressure, rotational speed, etc.

The central part 11a of the pivoting lever 11 is configured as a leaf spring. After assembly, this leaf spring is preloaded and acts in longitudinal direction on the adjusting shaft 9. The latter is moved radially inwards through the bush 10 by this means until the vane tip of the guide vane is in contact with the hub.

The machine construction is now designed in such a way that, in addition to the adjustment of the guide vanes during operation, the height of the flow duct can also be varied to adapt to different mass flows. For this purpose, provision is made for the vane carrier 3 and the cover 7 to be exchanged in accordance with the dotted representation in the drawing. The adjusting mechanism 9, 11, 12, 13 remains unaffected by this. The total length of the guide vanes that is, the combined length of the shaft 9, collar 15, and the vane aerofoil, as shown in the FIGURE similarly remains unaltered relative to the design case. In the case of the guide vanes, the axial length of the adjusting shaft 9 similarly remains unaltered. Only the height of the collar 15 is matched to the "new" length of the active vane aerofoil. This measure can only, of course, be effected with the machine open.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

1 Duct
2 Hub
3 Vane carrier
4 Casing
5 Rotor blade
6 Rotor disk
7 Cover
8 Adjustable guide vane
9 Shaft
10 Bush
11 Pivoting lever
11*a* Spring means 12 Pin 13 Adjusting ring 14 Inlet flow casing 15 Collar

What is claimed as new and desired to be secured by letters patent of the United States is:

1. An axial flow turbine comprising:

at least one row of individually adjustable guide vanes and at least one row of rotor blades, each guide vane including a vane blade mounted by a collar on a rotatable adjusting shaft, the shaft being supported in a casing:

an exchangeable vane carrier having an aperture through which the collar is positioned to support the vane blade in a flow duct; and, an exchangeable cover, against which tips of the rotor blades seal, wherein, to change the flow duct for a different mass flow, in addition to changing the height of the rotor blades and the vane blades, the collar is changed so that a total length of the vane blade, collar and shaft remains constant, and, only the vane carrier and the cover are exchanged, with otherwise unaltered machine geometry, to match the duct contour to the changed heights of blading.

* * * * *